United States Patent [19]

Witczak

[11] Patent Number: 4,729,308

[45] Date of Patent: Mar. 8, 1988

[54] CONVERTIBLE MOISTURE/INK SYSTEM IN PRINTING OR DUPLICATING MACHINES

[75] Inventor: Stanley Witczak, Chicago, Ill.

[73] Assignee: AM International, Inc., Chicago, Ill.

[21] Appl. No.: 892,556

[22] Filed: Aug. 4, 1986

[51] Int. Cl.[4] ..... B41F 7/26; B41F 31/06/31/30

[52] U.S. Cl. ..... 101/148; 101/350

[58] Field of Search ..... 101/148, 350, 352, 363, 101/147, 207, 208–210

[56] References Cited

U.S. PATENT DOCUMENTS

| | | | |
|---|---|---|---|
| 3,552,311 | 1/1971 | Petri | 101/148 |
| 3,911,815 | 10/1975 | Banfer | 101/148 |
| 3,926,116 | 12/1975 | Wildeman | 101/352 |
| 3,991,674 | 11/1976 | Petri | 101/148 |
| 4,130,057 | 12/1978 | Cist et al. | 101/352 |
| 4,290,360 | 9/1981 | Fischer | 101/148 |
| 4,351,236 | 9/1982 | Beisel et al. | 101/148 |
| 4,530,284 | 7/1985 | Fischer | 101/148 |
| 4,567,823 | 2/1986 | Hummel et al. | 101/148 |

FOREIGN PATENT DOCUMENTS 2440757 4/1975 Fed. Rep. of Germany ..... 101/148

*Primary Examiner*—J. Reed Fisher

*Attorney, Agent, or Firm*—Nicholas A. Camasto; John R. Hoffman

[57] ABSTRACT

A conversion system for readily changing a printing couple of a printing or duplicating machine between a separated system wherein moisture and ink are distributed to a master cylinder through separate paths and an integrated system wherein the moisture and ink are mixed in common paths to the master cylinder. A transfer roller of the main ink distribution system is bodily movable into and out of rolling contact with a moisture form roller of the main moisture distribution system to convert between the integrated and separated systems. The transfer roller is journalled on the machine and is so moved without removing or disconnecting the transfer roller. The driving connection of another transfer roller in the moisture feeding system is selectively switchable to change the location of slippage between the rollers in the moisture feeding system.

2 Claims, 8 Drawing Figures

FIG. 8
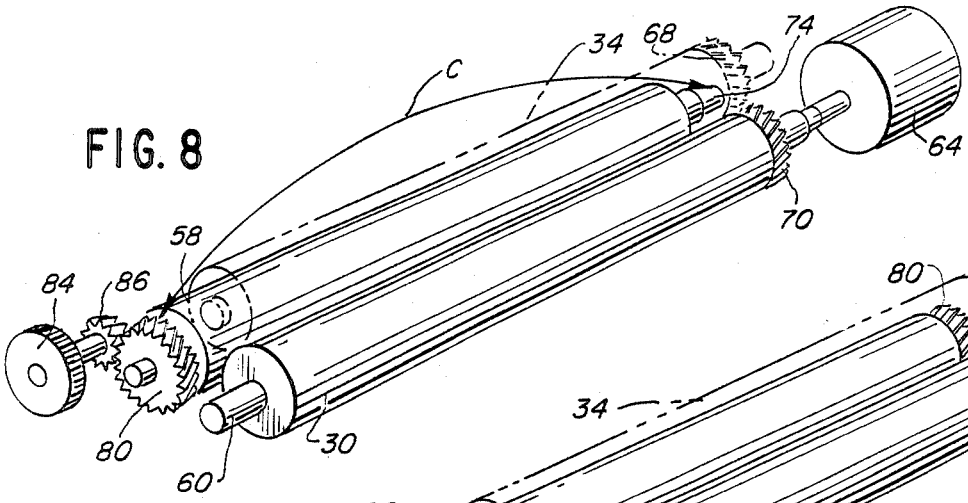
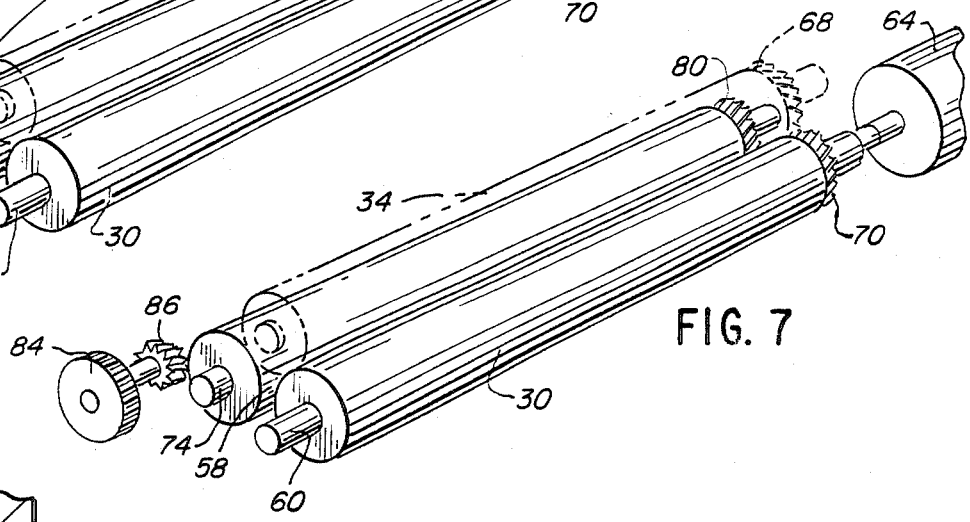
FIG. 7
FIG. 5
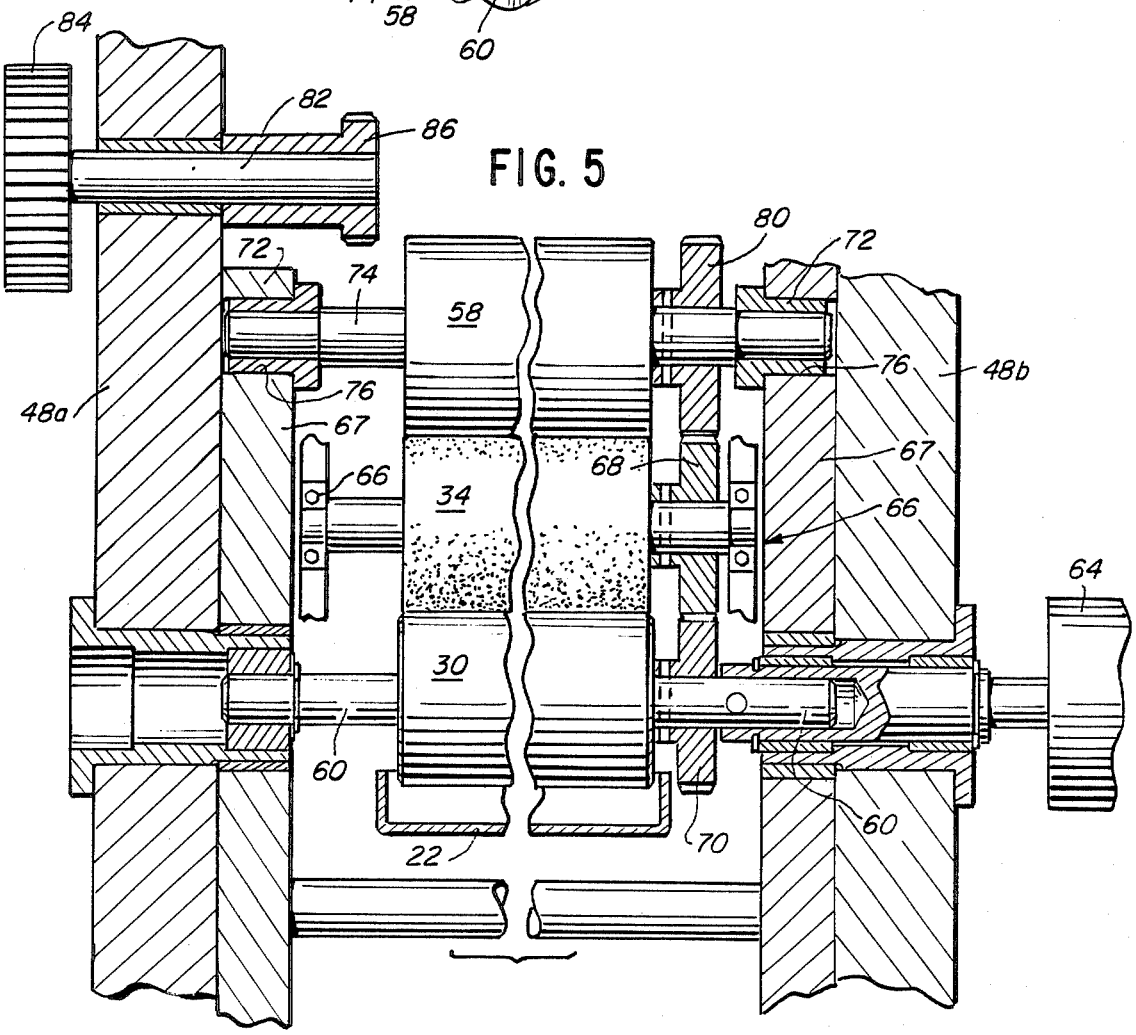

CONVERTIBLE MOISTURE/INK SYSTEM IN PRINTING OR DUPLICATING MACHINES

FIELD OF THE INVENTION

This invention generally relates to printing, duplicating or like machines and, particularly, to the moisture and ink distribution systems of the machines.

BACKGROUND OF THE INVENTION

Printing machines normally include a printing couple which comprises a number of cylinders and rollers such as an impression cylinder, a master cylinder, a blanket cylinder, form rollers, ductor rollers, transfer rollers, regulator rollers, and the like. For instance, an ink fountain conventionally is disposed generally at the rear of the machine for feeding ink to the various rollers of the printing couple which transfers images to copy sheets. In such printing machines as rotary offset lithographic duplicating machines, a moisture fountain also is disposed adjacent the printing couple for feeding moisture to the printing couple. A number of rollers, such as a fountain roller, a pickup roller, a transfer roller and a form roller, which generally can be termed "distribution" rollers, are provided between the moisture fountain and/or ink fountain for distributing moisture and/or ink to the printing couple of the machine.

There generally are two types of moisture and ink distribution systems in printing machines of the character described. One system commonly is called an "integrated" system wherein the moisture and ink are mixed in common paths leading to the master cylinder. The other system commonly is called a "separated" system wherein the moisture and ink are distributed to the master cylinder through separate paths. In the industry, a printing establishment conventionally will determine which system satisfies their needs and obtain and use a machine almost exclusively employing either an integrated system or a separated system. On occasion, it may be desirable to change from one system to the other. In such instances, the establishment either has to obtain a completely new machine which is set up with the other system or perform major overhaul operations on the existing machine to convert from one system to the other. Such conversions are both expensive and time consuming.

This invention is directed to providing a novel conversion apparatus for readily changing the printing couple of a printing, duplicating or like machine between the integrated and separated systems.

Another conversion problem encountered by printing establishments involves the moisture feeding system itself. As stated above, moisture feeding systems conventionally include a number of rollers for distributing moisture to a form roller in rolling contact with the master cylinder. Because of the different diameters of the various rollers and the imprecise gear ratios driving the rollers, there normally is slippage at one point or the other between the rollers of the moisture feeding system. In integrated systems, the slippage conventionally occurs between the transfer roller and the moisture form roller. However, there are certain instances in which a printing establishment may desire to employ a sleeve of fabric or fibrous material over the moisture form roller which engages the master cylinder. This normally is done in a separated system so that ink is not distributed onto the sleeve. The sleeve is provided for absorbing the moisture to constantly retain a residue of moisture in the sleeve which is believed to provide a more stable moisture feeding system. However, when such a sleeve is used, there can be no slippage between the moisture form roller and the adjacent transfer roller because such slippage would cause the sleeve to "bunch".

This invention further is directed to providing a system wherein the driving connection for the transfer roller of the moisture feeding system is convertible to either allow or avoid slippage between the transfer roller and the moisture form roller.

SUMMARY OF THE INVENTION

An object, therefore, of the invention is to provide a printing, duplicating or like machine which is readily convertible between an integrated moisture/ink system and a separated moisture/ink system.

Another object of the invention is to provide such a machine for changing the points of slippage between the rollers comprising the moisture feeding system.

In the exemplary embodiment of the invention, the printing, duplicating or like machine includes a frame mounting a printing couple with a moisture feeding system and an ink feeding system each having a plurality of rollers for distributing moisture and ink to a master cylinder. The invention contemplates a conversion apparatus for readily changing the printing couple between a separated system wherein the moisture and ink are distributed to the master cylinder through separate paths and an integrated system wherein the moisture and ink are mixed in common paths to the master cylinder.

Generally, the conversion apparatus includes a form roller in rolling contact with the master cylinder, and a transfer roller adjacent and generally parallel to the form roller. Means are provided for journalling the transfer roller on the machine frame, including means for readily moving the transfer roller between a first position in rolling contact with the form roller to define the integrated system and a second position out of rolling contact with the form roller to define the separated system. This conversion is accomplished without removing the transfer roller from the machine or even disconnecting the transfer roller.

Specifically, the transfer roller is journalled by bracket means movably mounted on the frame for moving the transfer roller toward and away from the form roller. Preferably, the bracket means are mounted on the frame for rotation relative to the frame about an axis eccentric to the axis of rotation of the transfer roller. Rotation of the bracket means bodily moves the transfer roller generally radially into and out of rolling contact with the form roller to readily convert the machine from an integrated system to a separated system and vice versa without removing or even disconnecting the transfer roller.

A moisture feeding system is provided for distributing moisture to the aforesaid form roller which is in rolling contact with the master cylinder. The moisture feeding system includes a moisture fountain having a fountain roller rotatable in the fountain, a pickup roller in rolling contact and driving connection with the fountain roller and a transfer roller in rolling contact between the pickup roller and the form roller. First drive means are provided for conjointing driving the fountain and pickup rollers. Second drive means are provided on the frame for selectively driving the transfer roller.

Means are provided for switching the operative driving connection of the transfer roller between the first and second drive means. In essence, this switches the point of slippage in the moisture feeding system.

Specifically, the first drive means for conjointing driving the fountain and pickup rollers are located at one end of the rollers. The second drive means are located at the opposite end, on the frame, but not in driving association with the fountain and pickup rollers. The transfer roller is invertible end-to-end for selective driving association with either the first or second drive means to thereby switch the point of slippage in the moisture feeding system.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 5 is a fragmented section, on an enlarged scale, taken through the moisture feeding system generally along line 5—5 of FIG. 2, with the rollers shown in plan;

FIGS. 7 and 8 are perspective views of the moisture system rollers to illustrate the end-to-end inverting of the transfer roller.

DETAILED DESCRIPTION OF THE PREFERRED EMBODIMENT

Figure 1:
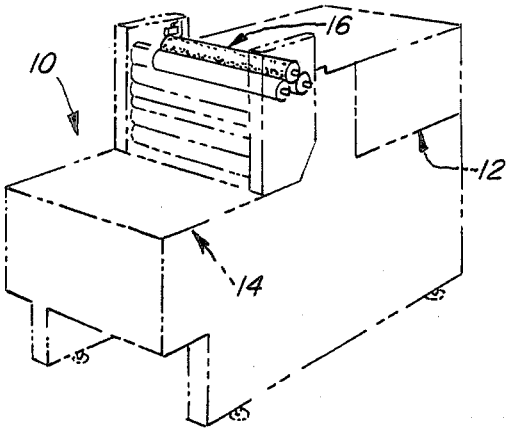
FIG. 1 is a somewhat schematic perspective view of a printing or duplicating machine in which the invention is applicable.

Referring to the drawings in greater detail, and first to FIG. 1, the invention is illustrated herein for use in a printing, duplicating or like machine, generally designated 10, which includes a sheet feeding end, generally designated 12, and an imaged copy exiting end, generally designated 14. The copy sheets which have images produced on one or both sides are stacked at exiting end 14 as is conventional with most printing or duplicating machines. The machine includes at least one printing couple, generally designated 16, which includes the conventional impression cylinders, blanket cylinders and master or plate cylinders. Usually, the printing couple includes one impression cylinder, one blanket cylinder and one master or plate cylinder.

Printing or duplicating machine 10 may be such as a rotary offset lithographic machine and includes an ink fountain for feeding ink to various distribution rollers of the printing couple which transfers images to copy sheets. In addition, a moisture fountain is disposed adjacent the printing couple for feeding moisture to the printing couple through a path defined by the distribution rollers. This invention is directed to a novel conversion apparatus for readily converting the printing couple between a separated system wherein the moisture and ink are distributed to the master cylinder through separate paths and an integrated system wherein the moisture and ink are mixed in common paths to the master cylinder. This invention also is directed to a novel means for switching the operative driving connection of the moisture system transfer roller to change the location of slippage in the moisture roller feeding system.

Figure 2:
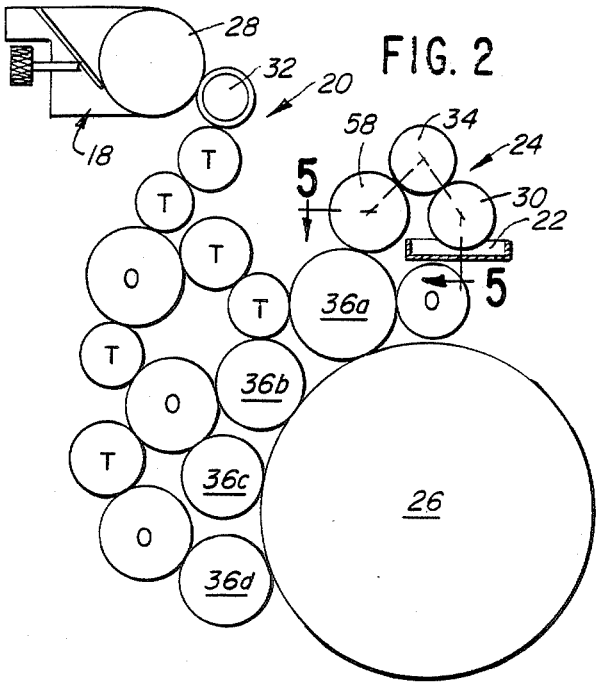
FIG. 2 is a somewhat schematic view of the rollers comprising the systems for feeding moisture and ink to the master cylinder, the rollers being arranged as an integrated system.
Figure 3:
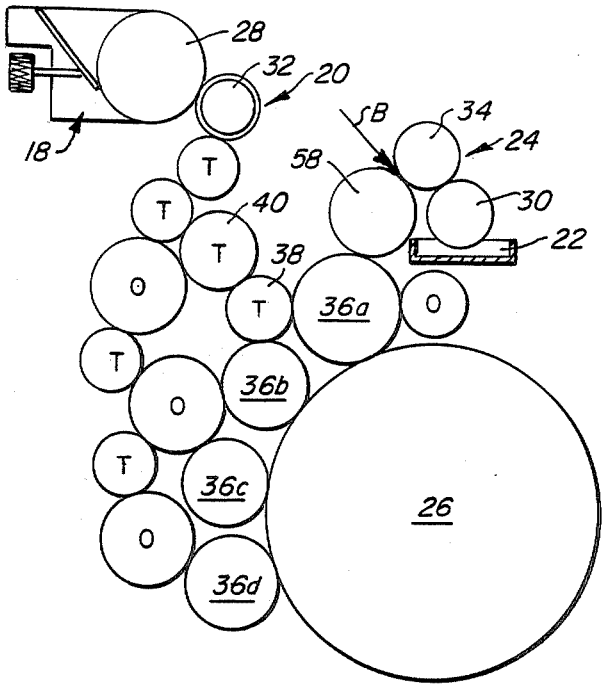
FIG. 3 is a view similar to that of FIG. 2 with the rollers arranged as a separated system.

More particularly, FIGS. 2 and 3 illustrate the moisture/ink roller system of the machine for distributing ink from an ink fountain, generally designated 18, through an ink feeding roller system, generally designated 20, and for feeding moisture from a moisture fountain 22 through a moisture feeding roller system, generally designated 24, to a master or plate cylinder 26. As will be described in greater detail hereinafter, certain rollers are located or arranged in FIG. 2 for providing an integrated moisture/ink system and are located or arranged in FIG. 3 for providing a separated moisture/ink system. An ink fountain roller 28 is rotatable in ink fountain 18, and a moisture fountain roller 30 is rotatable in moisture fountain 22. Pickup rollers 32 and 34 are provided in rolling contact with ink fountain roller 28 and moisture fountain roller 30, respectively.

The moisture/ink distribution system for distributing moisture and ink to master cylinder 26 includes four form rollers **36*a*,36*b*,36*c* and 36*d* in rolling contact with master cylinder 26**. A number of transfer rollers and oscillating rollers are provided in the distribution system and, for brevity purposes, have been designated "T" and "O", respectively.

It can be seen in FIG. 2 that a path can be drawn from any form roller **36*a*–36*d* back to either ink fountain 18 or moisture fountain 22. Therefore, the rollers in FIG. 2 are arranged to provide an integrated system wherein the moisture and ink are mixed in common paths from their respective fountains to master cylinder 26**.

FIG. 3 shows that transfer roller 38 has been moved out of rolling contact with form roller **36*a* to break any ink distribution path to that form roller. Consequently, FIG. 3 illustrates a separated system wherein the moisture and ink are distributed to master cylinder 26 through separate paths. Transfer roller 40 (FIG. 3) also is moved by transfer roller 38 by an appropriate sliding journal on the machine frame to accommodate selective movement of transfer roller 38** while maintaining rolling contact therewith.

Figure 4:
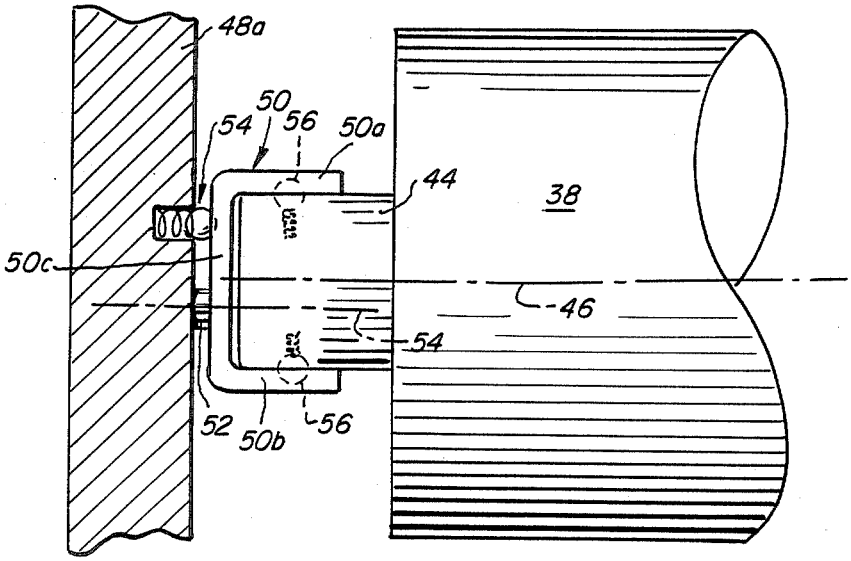
FIG. 4 is a fragmented section, on an enlarged scale, through the machine frame, with a plan view of the conversion apparatus for the convertible transfer roller.

FIG. 4 shows the conversion apparatus for moving transfer roller 38 and thereby converting the machine between an integrated system (FIG. 2) and a separated system (FIG. 3). More particularly, transfer roller 38 has stub shafts 44 projecting from opposite ends thereof and which define an axis of rotation 46 for roller 38. The stub shafts are journalled between frame plates 48 by bracket means, generally designated 50, which are generally U-shaped and include leg portions **50*a* and 50*b* joined by a bight portion 50*c* for embracing each stub shaft 44. Bracket 50 is mounted on frame plate 48 for rotation relative thereto about a mounting shaft 52. The mounting shaft defines an axis of rotation 54** for bracket 50 which, as seen, is eccentric to axis 46 of roller 38. Consequently, it can be seen that rotation of bracket 50 about axis 54 causes transfer roller 38 to move in an arc which essentially bodily moves the roller in a radial direction. This effects movement of the transfer roller into and out of rolling contact with form roller 36*a* as illustrated and described above in relation to FIGS. 2 and 3. The location of the brackets are such that transfer roller 38 is moved generally tangentially of form roller 36*b* so as to maintain constant rolling contact therewith. Spring loaded detent means, generally designated 54 (FIG. 4), are provided between frame plate 48 and bight portion 50*c* of bracket 50 to maintain the bracket and, therefore, the transfer roller in either its "integrated" or "separated" effective positions. Detent means 56 also may be provided between leg portions 50*a*,50*b* of bracket 50 and stub shaft 44 of roller 38 to provide for ready removal of the roller into and out of the U-shaped bracket if desired.

FIGS. 5–8 illustrate a feature of the invention wherein a transfer roller 58 between moisture pickup roller 34 and form roller 36*a* may be switched in its driving association in order to change the locations of slippage in the moisture feeding system. Generally, in an integrated system as illustrated in FIG. 2, slippage occurs between moisture form roller 36*a* and transfer roller 58, as indicated by arrow "A". This occurs due to the different diameters, speeds of rotation and other parameters of the system. However, in a separated system as shown in FIG. 3, it may be desirable to employ a fabric or fibrous sleeve on moisture form roller 36*a*. Under such circumstances, slippage cannot be permitted between moisture form roller 36*a* and transfer roller 58 because the sleeve would tend to "bunch". It therefore would be desirable to switch the point of slippage to a location between moisture pickup roller 34 and transfer roller 58, as indicated by arrow "B" in FIG. 3. This is accomplished by the switching means illustrated in FIGS. 5–8.

More particularly, fountain roller 30 includes a shaft 60 journalled by bearing means, generally designated 62, between frame plates 48*a* and 48*b*. A motor 64 appropriately drives shaft 60 and, therefore, rotates fountain roller 30. Pickup roller 34 is journalled by bearing means, generally designated 66, between mounting plates 67 on the inside surfaces of side frame plates 48*a*,48*b* in rolling contact with fountain roller 30. Pickup roller 34 is conjointly rotated with fountain roller 30 by means of a driven gear 68 in mesh with a drive gear 70 fixed to shaft 60 of fountain roller 30.

FIG. 5 shows that transfer roller 58, which is in rolling contact with pickup roller 34 and moisture form roller 36*a*, is provided with cup bearings 72 at opposite ends of a roller shaft 74. The bearings are positionable within slots 76 formed in mounting plates 67 fixed to the inside of frame plates 48*a*,48*b*. These slots are open in an upward direction to permit ready removal of transfer roller 58 by moving the cup-bearings out of slots 76. This permits transfer roller 58 to be inverted end-to-end, as described hereinafter. A gear 80 is fixed to shaft 74 of transfer roller 58 and, as seen in FIG. 5, gear 80 is in mesh with gear 68 of pickup roller 34. Through this gearing arrangement, all three fountain, pickup and transfer rollers are conjointly rotated by motor 64. This is the position of transfer roller 58 in the integrated moisture/ink system as illustrated in FIG. 2, wherein slippage will occur at "A" between transfer roller 58 and moisture form roller 36*a*. FIG. 7 shows the position of transfer roller 58 with all three gears 68,70 and 80 in mesh (with pickup roller 34 shown in phantom to facilitate the illustration).

Figure 6:
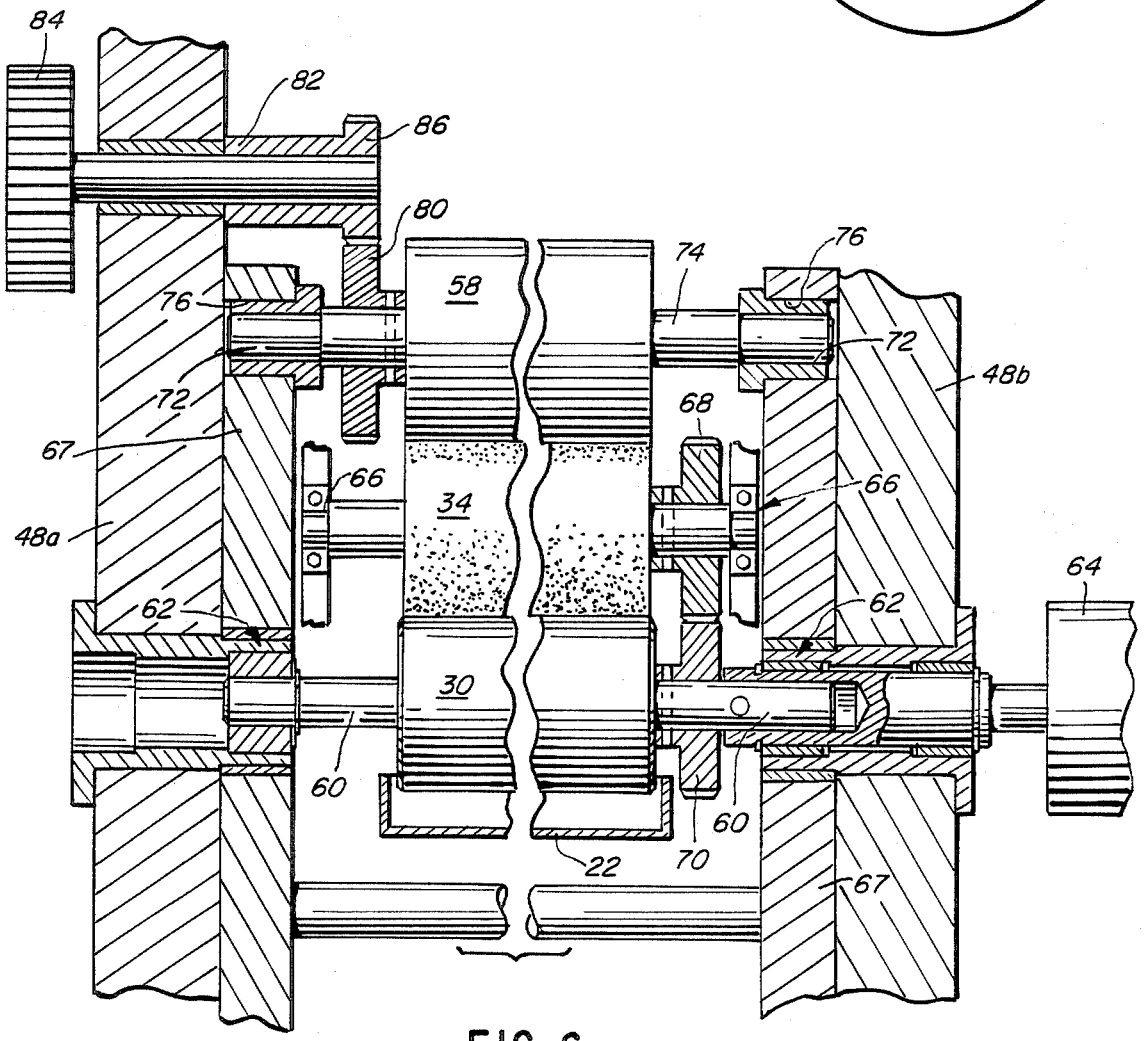
FIG. 6 is a view similar to that of FIG. 5, with the transfer roller of the moisture feeding system inverted end-to-end to switch its driving connection.

Referring to FIG. 6, an independent drive shaft 82 projects through frame plate 48 and mounting plate 67. A drive pulley 84 is provided on the end of shaft 82 outside frame plate 48*a*, and a drive gear 86 is provided on the inner distal end of the shaft inside mounting plate 67. Drive pulley 84 is operatively associated and driven in synchronization with the main driving mechanism of the machine. It can be seen in FIG. 6 that transfer roller 58 has been removed and inverted end-to-end so that its drive gear 80 now has been effectively shifted to the opposite end for meshing with drive gear 86. In other words, the driving association of transfer roller 58 with fountain roller 30 and pickup roller 34 (i.e. gears 68 and 70) no longer exists and transfer roller 58 now is independently driven through drive gear 86. Slippage now occurs between transfer roller 58 and pickup roller 34 as indicated at arrow "B" in FIG. 3 in the separated system of the machine as illustrated. Rotation of transfer roller 58 now is synchronized with rotation of moisture form roller 36*a* so that no slippage occurs between those rollers. The transfer roller now can be installed with a sleeve and the problems of "bunching" of the sleeve are eliminated.

FIG. 8 shows the inversion end-to-end of transfer roller 58, as indicated by double-headed arrow "C" with its gear 80 in operative meshing engagement with drive gear 86 (again, with pickup roller 34 shown in phantom to facilitate illustration).

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a printing machine, a moisture feeding system for distributing moisture to a form roller in a rolling contact with a master cylinder, comprising:
- a moisture fountain having a fountain roller rotatable in the fountain;
- a pickup roller in rolling contact and driving connection with the fountain roller;
- a transfer roller in rolling contact between the pickup roller and said form roller;
- first drive means located at one axial end of the fountain and pickup rollers for conjointly driving the fountain and pickup rollers;
- second drive means located at an axial end opposite said one end for selectively driving the transfer roller;
- engaging means at one axial end of said transfer roller for operative driving connection with either said first and second drive means; and
- means mounting the transfer roller so as to be invertible end-to-end for switching the operative driving connection of the transfer roller between said first and second drive means.

2. In a printing machine as set forth in claim 1, wherein the fountain roller and pickup roller include engaging gear means at said one end thereof, the second drive means has gear means opposite said one end, and the engaging means of said transfer roller has gear means at said one axial end thereof for engagement with either the gear means of the fountain and pickup rollers and the gear means of the second drive means depending on the end-to-end position of the transfer roller.

* * * * *